US009750336B2

(12) United States Patent
Vandenbroucke

(10) Patent No.: US 9,750,336 B2
(45) Date of Patent: Sep. 5, 2017

(54) RESERVOIR HANDLE FOR A CLEANING ELEMENT SUCH AS A BRUSH, WIPER OR SIMILAR

(71) Applicant: WAAK-BW VZW, Kuurne (BE)

(72) Inventor: Kris Vandenbroucke, Sint-Eloois-Winkel (BE)

(73) Assignee: WAAK-BW VZW, Kuurne (BE)

( * ) Notice: Subject to any disclaimer, the term of this patent is extended or adjusted under 35 U.S.C. 154(b) by 224 days.

(21) Appl. No.: 14/674,259

(22) Filed: Mar. 31, 2015

(65) Prior Publication Data

US 2015/0272314 A1 Oct. 1, 2015

(30) Foreign Application Priority Data

Apr. 1, 2014 (BE) ..... 2014/0222

(51) Int. Cl.

| | |
|---|---|
| ***A46B 11/00*** | (2006.01) |
| ***A47L 13/22*** | (2006.01) |
| ***B25G 3/36*** | (2006.01) |

(52) U.S. Cl.

CPC ..... *A46B 11/0062* (2013.01); *A47L 13/22* (2013.01); *B25G 3/36* (2013.01)

(58) Field of Classification Search

CPC combination set(s) only.
See application file for complete search history.

(56) References Cited

U.S. PATENT DOCUMENTS

| | | | | |
|---|---|---|---|---|
| 2,609,557 | A | 9/1952 | Reed | |
| 9,433,334 | B2 * | 9/2016 | Tomm | A47L 13/22 |
| 2003/0197027 | A1 | 10/2003 | Dyer | |
| 2004/0265037 | A1 * | 12/2004 | Vosbikian | A47L 13/12 401/139 |

FOREIGN PATENT DOCUMENTS

| | | |
|---|---|---|
| BE | 1014287 | 8/2003 |
| EP | 1273259 | 8/2003 |

OTHER PUBLICATIONS

Belgium Search Report dated Nov. 24, 2014, in corresponding Belgium application 201400222.

* cited by examiner

*Primary Examiner* — David Walczak
(74) *Attorney, Agent, or Firm* — Young & Thompson

(57) ABSTRACT

Reservoir handle for a cleaning element (2) that is provided with a handle (3) in the form of a refillable reservoir (15) for liquid with a filler opening (14) and outlet (16, 33) with an operable valve (17) and an operating button (8) that can be pushed in axially to open the valve (17) to let liquid out of the reservoir (15), whereby the operating button (8) includes a stopper (25) for the reservoir (15) that is axially movable in the handle (3) between a closed position in which the reservoir (15) is closed when the operating button (8) is not pressed in and a filling position in which the reservoir (15) is connected to the environment via the filler opening (14) in order to be able to fill the reservoir (15).

20 Claims, 7 Drawing Sheets

RESERVOIR HANDLE FOR A CLEANING ELEMENT SUCH AS A BRUSH, WIPER OR SIMILAR

BACKGROUND OF THE INVENTION

The invention concerns a reservoir handle for a cleaning element such as a brush, wiper or similar that is fastened at the bottom of the reservoir handle.

DESCRIPTION OF THE RELATED ART

Such a reservoir handle is known for example from BE 1.014.287 for use in a cleaning device of the type that is intended for cleaning a floor, in particular for cleaning by adding a liquid such as water and/or another liquid cleaning product that can be stored in the reservoir handle and which is then released according to need in order to make the floor wet or to apply a cleaning product or similar.

Such a known reservoir handle is provided with a handle that is formed as a refillable reservoir for liquid with a lateral filler opening at the top in order to be able to fill the reservoir, and an outlet more at the bottom that is closed by an operable valve, whereby means are provided to push open the valve in the form of an operating button that is connected to the valve via a rod, whereby the operating button is affixed movably in an axial direction on the handle and can be pressed in to open the valve in order to let liquid flow from the reservoir.

An advantage of such a reservoir handle with lateral filler opening is that the reservoir can easily be filled with water under a tap.

However, a disadvantage of such a reservoir handle is that, when it is filled with liquid, the handle must also be kept in a more or less upright position with the filler opening at the top in order to prevent the liquid being able to flow out unintentionally via the filler opening.

Another disadvantage that is found in practice with such a known reservoir handle is that the components are reasonably loose and consequently can rattle during cleaning, which can be irritating.

In the known reservoir handle, the operating button and the filler opening are affixed in a removable cap that is slid on the handle and which is sometimes removed to clean the reservoir handle, with the disadvantage that this cap and/or the operating button can sometimes become lost with all unpleasant consequences coupled thereto and whereby the reservoir handle becomes unusable for the application for which it is intended.

BRIEF SUMMARY OF THE INVENTION

The purpose of the present invention is a reservoir handle that enables the aforementioned and other disadvantages to be remedied during use, or at least minimised, without affecting the known advantages, whereby such a reservoir handle is also easy to realise and is constructed such that it is practical to use.

To this end the invention concerns a reservoir handle of the aforementioned type whereby the operating button comprises a stopper for the reservoir that is axially movable on or in the handle or an extension piece thereof, between a closed position in which the reservoir is closed off from the environment when the operating button is not pressed in and a filling position in which the reservoir is connected to the environment via the filler opening to enable the filling of the reservoir.

With a reservoir handle according to the invention the operating button can also act as a stopper to close the lateral filler opening when the reservoir is filled with liquid, while in this closed position the operating button can nevertheless act as an operating button to let the liquid outside when necessary.

In this way it is possible to hold and use the reservoir handle in all possible directions, even upside down, without liquid being able to leak unintentionally from the reservoir handle.

Due to the integrated function of the operating button and stopper, a separate stopper is not needed to seal off the filler opening, such that such a valve cannot be lost and cannot interfere with the function of the operating button either.

BRIEF DESCRIPTION OF THE DRAWINGS

With the intention of better showing the characteristics of the invention, a preferred embodiment of a reservoir handle according to the invention is described hereinafter by way of an example, without any limiting nature, with reference to the accompanying drawings, wherein:

FIG. 3 shows a longitudinal cross-section of the reservoir handle of FIG. 1 in the exploded view of FIG. 2;

DETAILED DESCRIPTION OF THE PREFERRED EMBODIMENTS

Figure 1:
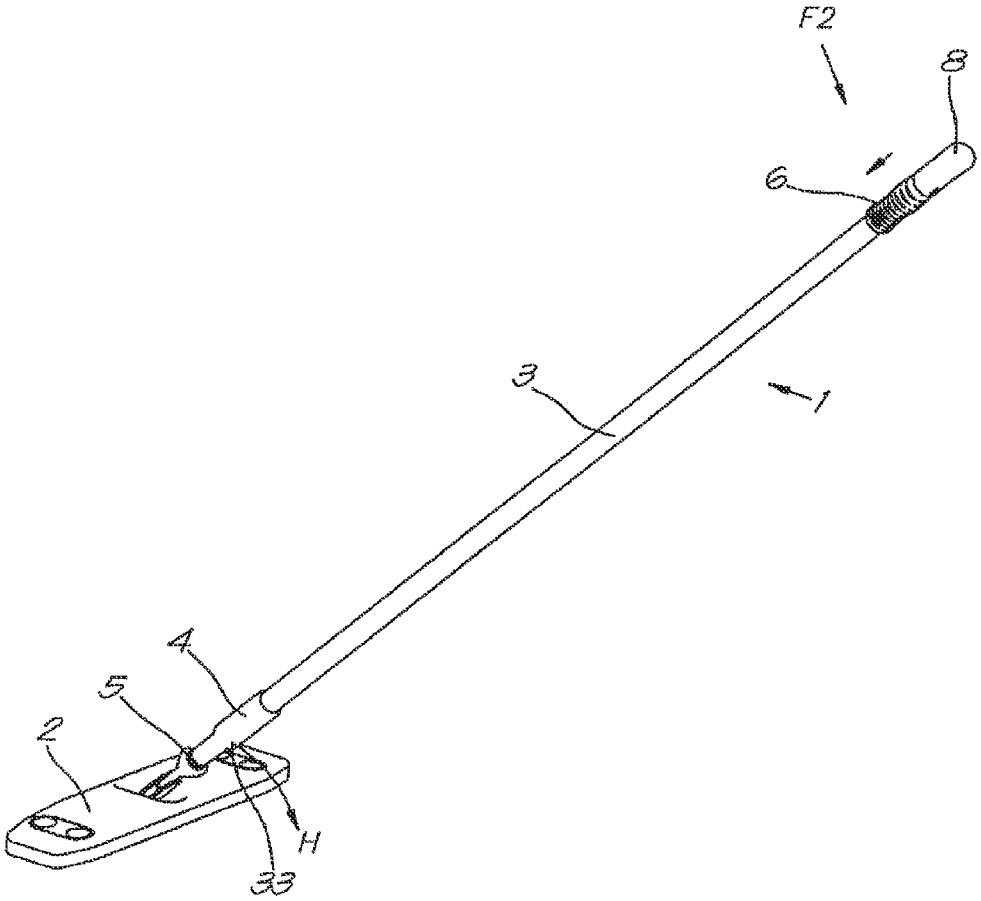
FIG. 1 schematically shows a perspective view of a reservoir handle according to the invention in a ready-to-use state equipped with a cleaning element for cleaning a floor.

The reservoir handle 1 according to the invention shown in FIG. 1 is in this case provided with a known cleaning element 2 to which a floorcloth or cleaning cloth or similar can be fastened for cleaning a floor.

As can be seen in the cross-section of FIG. 3, in this case the reservoir handle 1 is essentially formed from a handle 3 in the form of a hollow tube 3' that is provided at the bottom with an end piece with a coupling piece 5 for fastening the cleaning element 2, and is provided on top with a handgrip 6 with a tubular cylindrical extension piece 7 with outside diameter A and inside diameter B that extends in an axial direction and as it were forms an extension of the handle on which an operating button 8 can be affixed.

Figure 2:
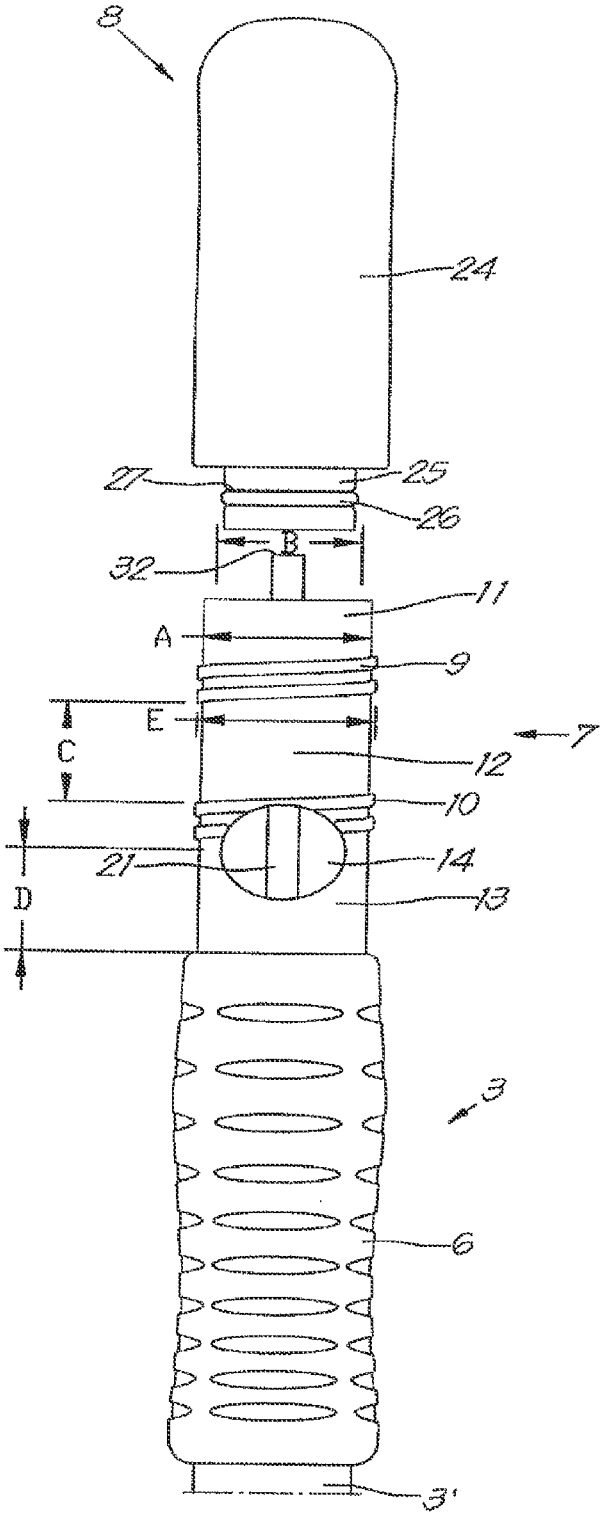
FIG. 2 shows a top view of the handgrip of the reservoir handle of FIG. 1 on a larger scale, in an exploded view.

On the extension piece 7 of the handle 3, referring to FIG. 2, two short threaded sections of a few windings are provided at an axial distance C from one another, respectively a first threaded section 9 and a second threaded section 10 that is located closer, with respect to the first threaded section 9, to the end piece 4 at the bottom end of the handle 3 and at a distance D from the handgrip 6.

The threaded sections 9 and 10 have an outside diameter E that is greater than the outside diameter A of the extension piece 7 and as it were are on top of the outer surface of the extension piece 7 of the handle 3 such that it protrudes radially with respect to this outside surface.

The threaded sections 9 and 10 divide the extension piece 7 into three coaxial cylindrical zones with outside diameter A without screw thread, i.e. a zone 11 at the top end of the extension piece 7, a zone 12 between the two threaded sections 9 and 10, and a zone 13 between the second threaded section and the handgrip 6.

A lateral filler opening 14 is provided in the extension piece 7, which in this case is at the location of the bottom zone 13 of the extension piece and partially overlapping in the second threaded section 10.

The orientations such as bottom, top and similar in the context of the description must be viewed for a reservoir handle 1 that is oriented upwards in use, as shown in FIG. 1 with the handgrip 6 at the top.

The hollow handle 3 forms a reservoir 15 for a liquid, and to this end is provided at the bottom in a known way with an outlet 16 that is closed by a valve 17 in the form of a disk 18 that is pressed against a seat 20 of the valve 17 by means of a compression spring 19 to obtain a leak-free seal of the outlet 16, whereby the compression spring 19 is in the end piece 4.

The disk 18 of the valve 17 can be operated by means of a rod 21 that extends through the reservoir 15 and the handgrip 6 with extension piece 7.

The operating button 8 is provided with a central guide, in this case in the form of a bore 22, by which the operating button 8 can be slid over the top end of the rod 21, whereby the bore 22 is provided with a conical entrance 23 in order to guide the rod 21 into the bore when affixing the operating button 8 on the rod 21.

The operating button 8 is composed of a cap 24 that can be affixed over the extension piece 7 and a cylindrical stopper 25 coaxially fastened therein for closing the reservoir 15 at the top, whereby in this case this stopper 25 is provided at its base with a seal 26 in the form of an O-ring that is affixed in a peripheral groove 27 of the stopper 25, and which is provided at the head with a snap connector 28 with which the stopper 25 can be snapped in the cap 24 in a way that the stopper 25 is locked in an axial direction in the cap 24, but a turning movement of the stopper 25 in the cap 24 still remains possible.

The cap 24 is constructed with a cylindrical shell 29 with inside diameter F in which a threaded section 30 is provided at the bottom that can mate with the threaded sections 9 and 10 of the extension piece 7 of the handle 3, whereby this threaded section 30 in the cap 24 has an inside diameter G that is somewhat larger than the outside diameter A of the zones 11, 12 and 13 of the extension piece 7, and whereby this threaded section 30 protrudes inwards radially with respect to the inside surface of the shell 29.

Figure 5:
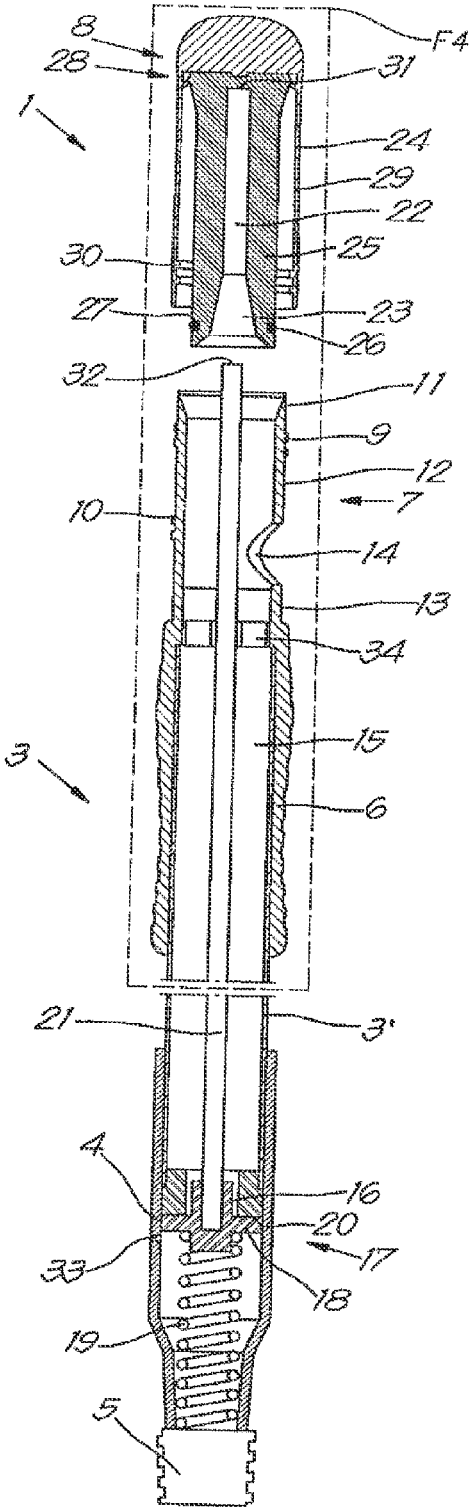
FIGS. 5 and 6 are analogous to FIGS. 2 and 4, but for a filled state of the reservoir handle.
Figure 4:
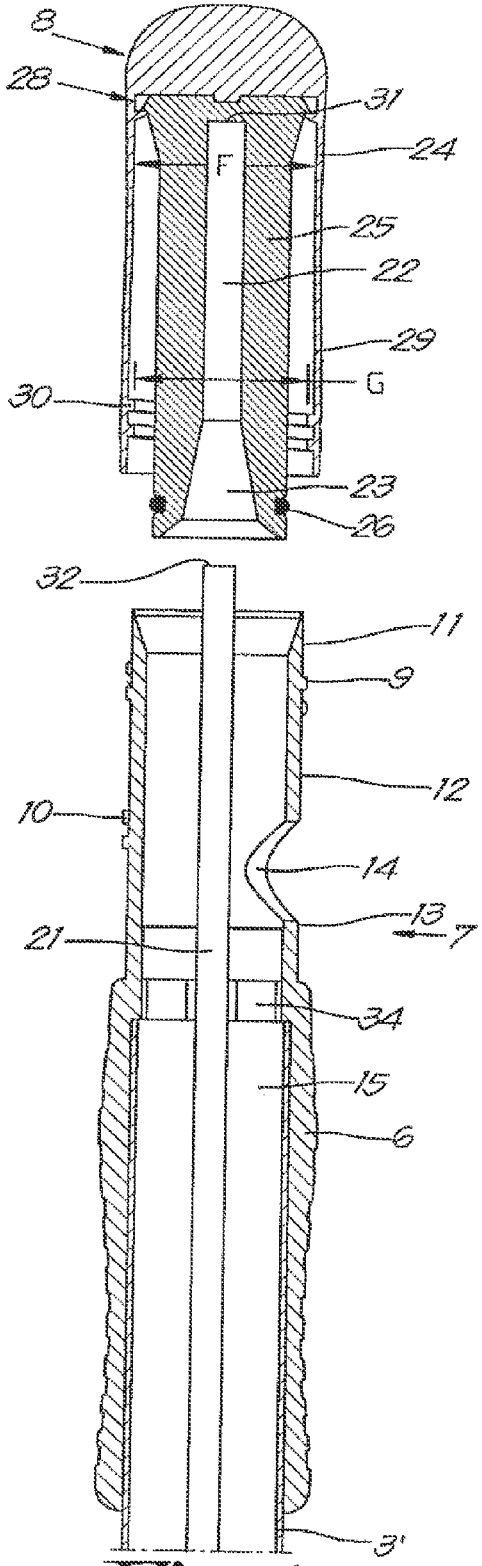
FIG. 4 shows the section indicated by F4 in FIG. 3 on a larger scale.
Figure 5:
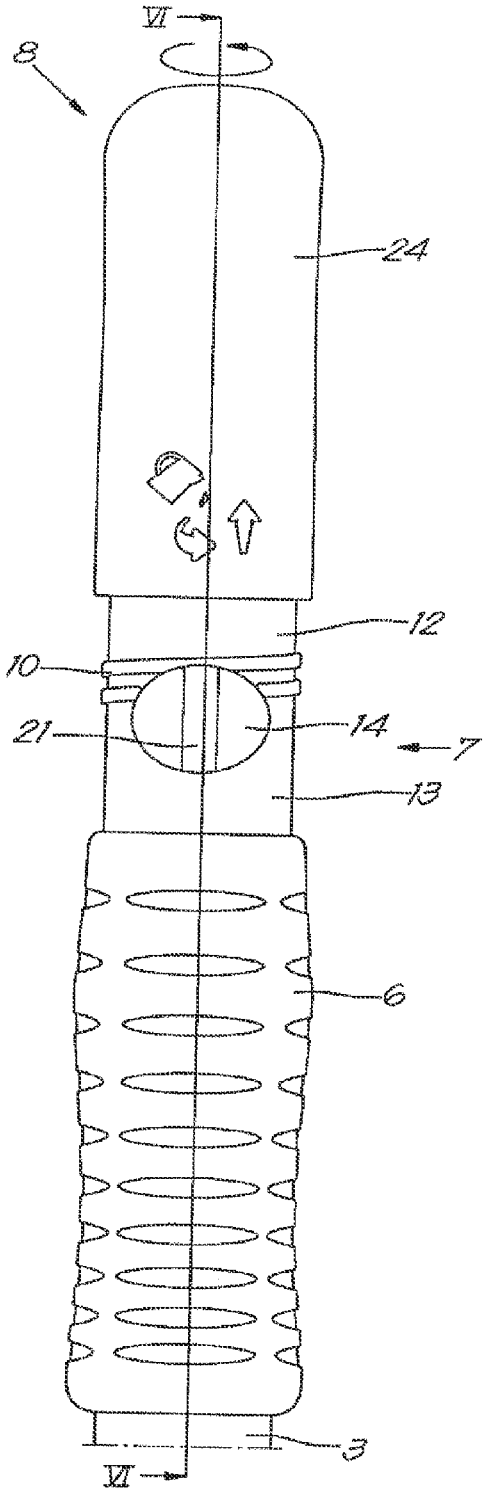
Figure 6:
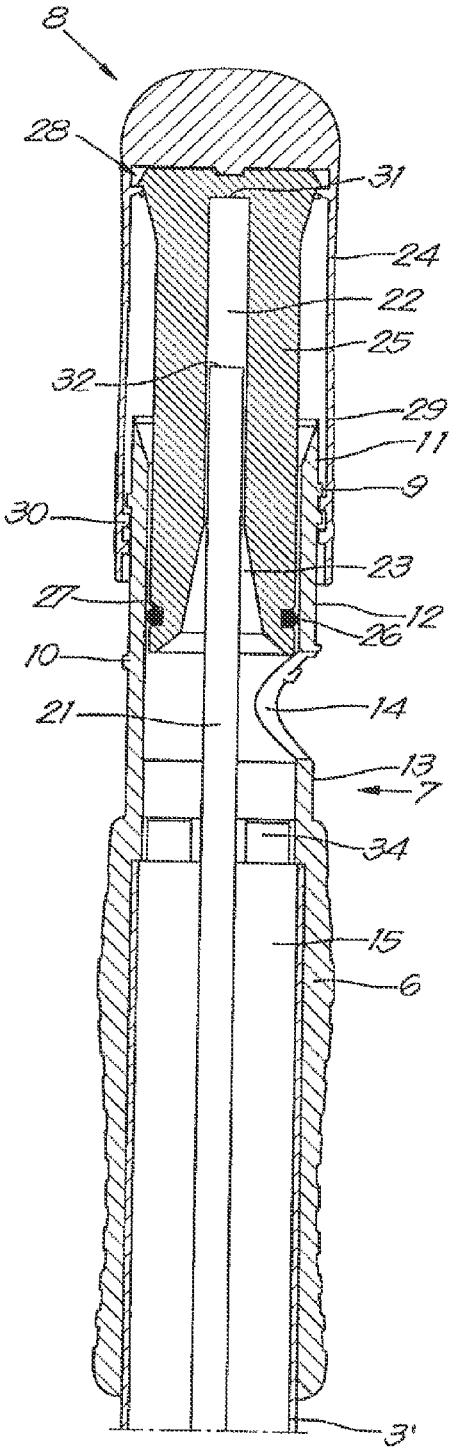

During assembly of the reservoir handle 1 according to the invention, the stopper of the operating button 8 is slid over the top end of the rod 21 and the cap 24 is affixed over the zone 11 of the extension piece 7, after which the cap 24 is screwed, via a first screwed connection, between its threaded section 30 and the first threaded section 9 of the handle 3, as shown in FIGS. 5 and 6.

In this situation the stopper 25, more specifically the seal 26 of the stopper 25, is completely above the filler opening 14 such that the reservoir 15 can be filled, for example by keeping the reservoir handle 1 with its filler opening 14 under a tap.

For filling, the cap 24 can be further screwed down until the threaded section 30 of the cap 24 goes past the first threaded section 9 of the handle 3 up to this zone 12 between the two threaded sections 9 and 10. In this situation the cap 24 can be moved over a distance C along the handle 3, whereby the movement is limited by the threaded sections 9 and 10 of the handle 3 forming an end stop for the threaded section 30 of the cap 24.

For filling, in this situation the cap 24 can be slid upwards to a maximum until the first threaded section 9 of the handle 3 forms an end stop for the threaded section 30 of the cap.

In principle, after the first assembly of the reservoir handle 1, the cap 24 is never screwed more on the first threaded section 9 so that the cap 24 can always remain mounted on the handle 3 and does not need to be unintentionally removed from the reservoir handle 1, and thereby cannot get lost.

Figure 7:
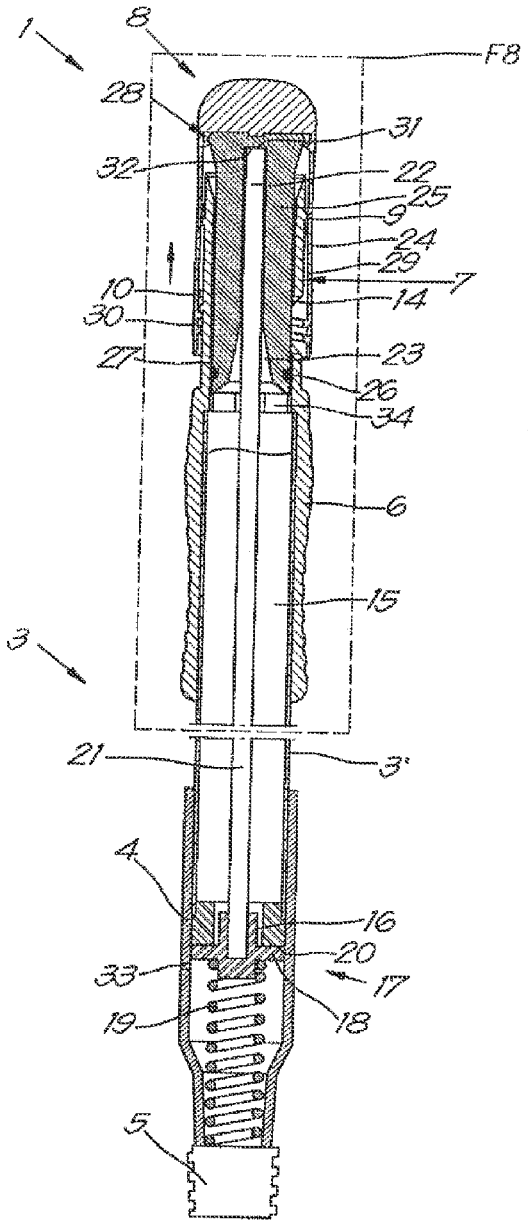
FIG. 7 shows a longitudinal cross-section of the reservoir handle of FIG. 1 in the ready-to-use state of FIG. 1.
Figure 8:
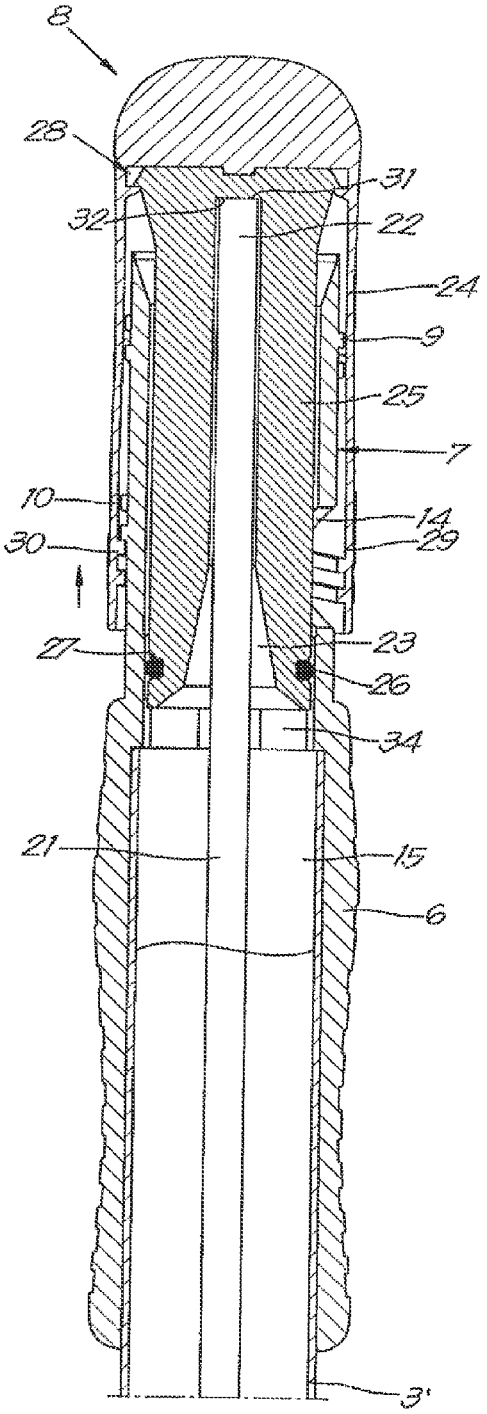
FIG. 8 shows the section indicated by F8 in FIG. 7 on a larger scale.

Once the reservoir 15 has been sufficiently filled, this reservoir 15 is closed by pushing the stopper 25 deeper into the extension piece 7 of the handle 3 by now screwing on the cap 24 with the second screwed connection between the second threaded section 10 and the threaded section 30 until the threaded section 30 of the cap 24 goes past the second threaded section 10 into the zone 13, as shown in FIGS. 7 and 8.

The length of the rod 21 and the depth of the bore 22 are preferably chosen such that when the threaded section 30 of the cap 24 just passes the second threaded section 10 of the handle 3, the base 31 of the bore 22 does not quite touch the head 32 of the rod 21, preferably with a small clearance of one millimeter for example to prevent the disk 18 from being pushed open by the rod 21 when screwing on the cap 24 with the second screwed connection.

It is clear that is in this situation of FIGS. 7 and 8, the stopper 25 completely closes the reservoir at the top and prevents liquid from being able to leak out of the reservoir 15 to the outside via the filler opening 14, not even when the reservoir handle 1 is held upside down.

In the situation of FIGS. 7 and 8 it is possible to push in the operating button 8 axially over a maximum distance D corresponding to the height of the zone 13, if applicable limited to the travel of the disk 18 of the valve 17 if this is smaller than the maximum distance D.

Figure 9:
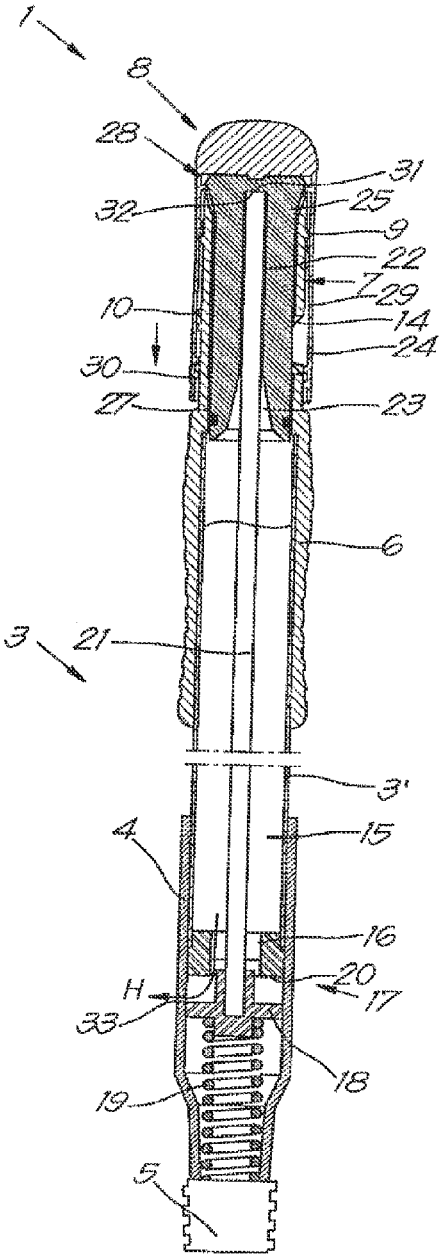
FIGS. 9 and 10 are analogous drawings to FIGS. 7 and 8, but in a situation in which the operating button has been pushed in to let liquid out of the reservoir.
Figure 10:
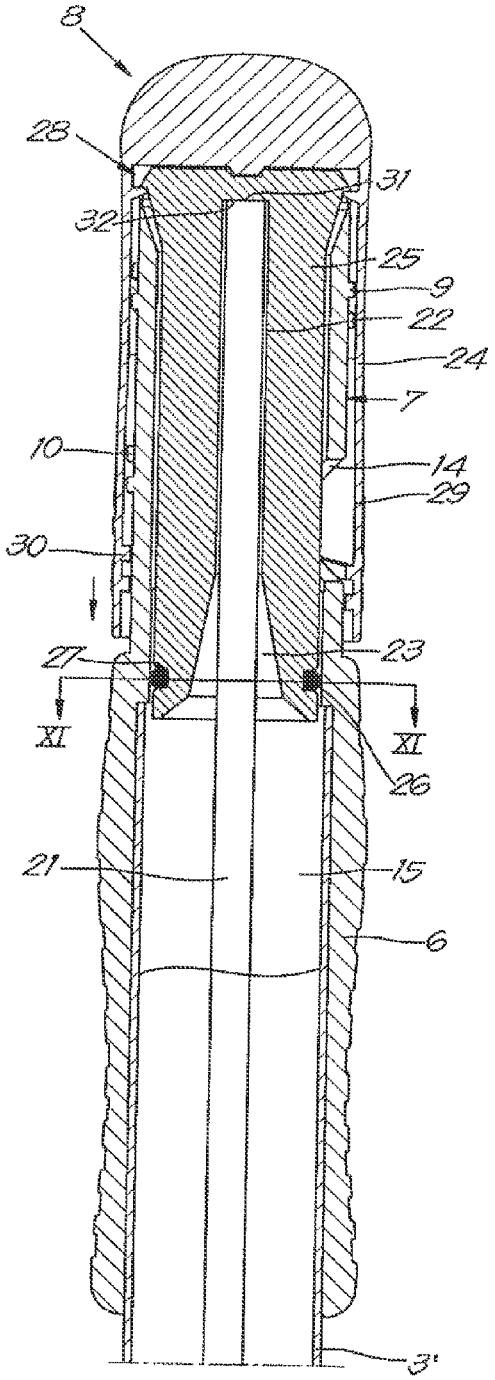

When pushing in, the disk 18 is pushed downwards by the rod 21 such that the valve 17 opens, as shown in FIGS. 9 and 10, and the liquid can escape from the reservoir 15 to the outside via the outlet 16 and an outlet 33 in the end piece 4, as shown by arrow H in FIG. 9 and in FIG. 1 in order to moisten the floor or to apply a detergent or similar.

Figure 11:
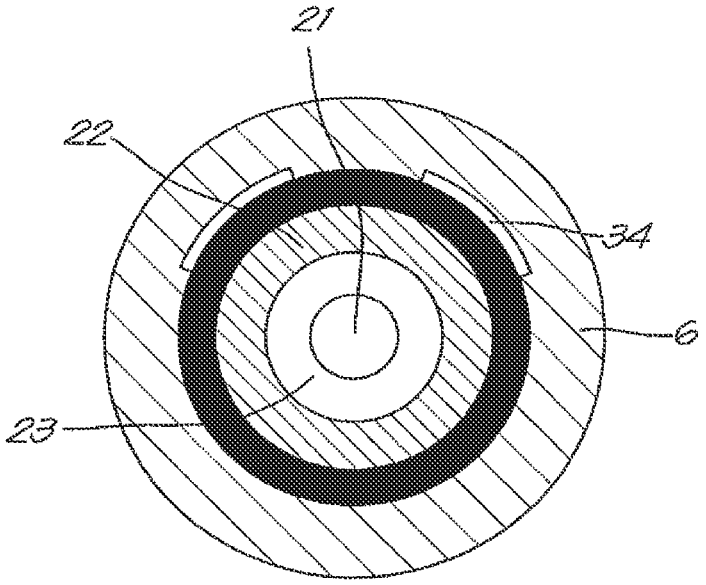
FIG. 11 shows a transverse cross-section according to line XI-XI in FIG. 10.

In this situation the seal 26 of the stopper 25 is in the bottom section of the extension piece 7, just above the top end of the tube 3' at a place where cutaways 34 are provided in the inside surface with diameter B, which can be seen in the cross-sections of FIGS. 11 and 8, and which ensure that in this position of the seal 26, the reservoir 15 is connected to the environment via the filler opening 14 to allow air into the reservoir 15 to prevent a vacuum forming above the level of the liquid, that would otherwise prevent the outflow of the liquid through the outlets 16 and 33.

When sufficient liquid has come out of the reservoir 15 onto the floor, the operating button 8 can be released again, such that the spring 19 pushes the disk 18 upwards against the seat 20 and thereby also pushes the rod 21 and the stopper 25 of the operating button 8 upwards to the position of FIG. 8, whereby the stopper 25 is above the cutaways 34 and closes the reservoir 15 and whereby the second threaded section 10 and the threaded section 30 mating therewith almost come into abutment against one another.

It is clear that alternatively the first and second threaded sections 9 and 10 can also be provided on the cap 24, and the screw thread 30 mating therewith can be provided on the handle 3.

It is clear that the threaded sections 9 and 10 can also be provided directly on the tube 3' of the handle and thus the filler opening 14 can also be provided directly in the tube 3' of the handle 3, in which case a separate extension piece 7 would not be required.

The advantage of the extension piece 7 is that it can be made of plastic as a single injection moulded part, whether or not together with the handgrip 6.

It is not excluded that the threaded sections 9, 10 and 30 are provided between the inside surface of the handle 3 or its extension piece 7 and the outside surface of the stopper 25, instead of between the inside surface of the cap 24 and the outside surface of the handle 3.

Instead of providing two separate threaded sections 9 and 10, it is also possible to integrate both threaded sections into one continuous screw thread that runs through the zone 12.

Instead of a mechanical rod connection between the operating button 8 and the valve 17, an electrical connection is not excluded, whereby in that case the valve 17 would be an electric valve that is connected to a switch on top of the handle 3, whereby this switch is operated by the operating button 8 with integrated stopper 25.

It goes without saying that in this last case a power source will be needed, for example in the form of a battery that can also be used to operate a pump that could be connected to a sprayer or similar.

The present invention is by no means limited to the embodiment described as an example and shown in the drawings, but such a reservoir handle according to the invention for a brush, cloth or similar, can be realised according to different variants, without departing from the scope of the invention.

The invention claimed is:

1. A reservoir handle for a cleaning element (2), the reservoir handle comprising:

a handle (3) comprised of a hollow tube (3') that forms a refillable reservoir (15) for liquid within the hollow tube (3'), the refillable reservoir (15) having a reservoir top and a reservoir bottom, the hollow tube (3') having a top end and a bottom end, wherein the bottom end is fastenable to the cleaning element (2);

an extension piece (7) that extends the top end of the hollow tube (3');

a lateral filler opening (14) extending through a wall of the extension piece (7);

an outlet (16, 33) located at the reservoir bottom;

an operable valve (17) that opens and closes the outlet (16, 33);

an operating button (8) affixed to the extension piece (7), the operating button (8) being connected to the valve (17), the operating button (8) being affixed movably in an axial direction on the handle (3), wherein pushing the operating button (8) in the axial direction opens the valve (17) to let liquid out of the reservoir (15), wherein the operating button (8) comprises a stopper (25) that is axially movable in the extension piece (7) between i) a closed position in which the reservoir (15) is closed off from the environment when the operating button (8) is not pressed in and ii) a filling position in which the reservoir (15) is connected to the environment via the filler opening (14) in order to be able to fill the reservoir (15).

2. The reservoir handle according to claim 1, wherein the extension piece (7) is constructed as a cylindrical tubular form and that the stopper (25) is provided with a seal (26) for sealing the stopper (25) in the extension piece (7), whereby the stopper (25) is affixed movably in the axial direction.

3. The reservoir handle according to claim 2, wherein the operating button is provided with a cap (24) that fits over a top end of the extension piece (7) and which is connected to the stopper (25).

4. The reservoir handle according to claim 3, further comprising a first screwed connection between the extension piece (7) and the operating button (8) to be able to screw the operating button (8) on the extension piece (7) during assembly.

5. The reservoir handle according to claim 2, further comprising a first screwed connection between the extension piece (7) and the operating button (8), the first screwed connection allowing the operating button (8) to be screwed on the extension piece (7) during assembly.

6. The reservoir handle according to claim 5, further comprising a second screwed connection between the extension piece (7) and the operating button (8), the second screwed connection allowing the stopper (25) to be moved axially in the extension piece (7) until the seal (26) of the stopper (25) is below a level of the filler opening (14), corresponding to the closed position.

7. The reservoir handle according to claim 6, wherein the operating button (8), or extension piece (7), is provided with a threaded section (30) that can mate with a first threaded section (9) on the extension piece (7), or operating button (8), to form the first screwed connection (9-30), and together with a second threaded section (10) on the extension piece (7), or operating button (8), to form the second screwed connection (10-30), whereby the first and second threaded sections (9 and 10) are at an axial distance (C) from one another.

8. The reservoir handle according to claim 7, wherein the second threaded section (10) is located closer to the bottom end of the handle (3) than the first threaded section (9).

9. The reservoir handle according to claim 8, wherein the second threaded section (10) and the threaded section (30) mating therewith are positioned on the extension piece (7) and on the operating button (8) such that, when the second threaded section (10) is screwed in the direction of the bottom end of the handle (3) past the threaded section (30) mating therewith, the operating button (8) can be pressed over a certain distance to be able to use this operating button (8) to open the aforementioned valve (17) during use for cleaning.

10. The reservoir handle according to claim 7, wherein the second threaded section (10) and the threaded section (30) mating therewith are positioned on the extension piece (7) and on the operating button (8) such that, when the second threaded section (10) is screwed in the direction of the bottom end of the handle (3) past the threaded section (30) mating therewith, and the operating button (8) can be pressed over a certain distance to be able to use the operating button (8) to open the valve (17) during use for cleaning.

11. The reservoir handle according to claim 10, wherein the filler opening (14) at least partially extends in the axial direction below the second threaded section (10).

12. The reservoir handle according to claim 7, wherein the threaded section (30) and the first and second threaded sections (9, 10) are provided on the outside surface of the extension piece (7) and on the inside surface of the cap (24).

13. The reservoir handle according to claim 12, wherein the threaded section (30) and the first and second threaded sections (9, 10) protrude out of the outside surfaces of the extension piece (7) and the cap (24).

14. The reservoir handle according to claim 12, wherein the inside diameter (G) of the threaded sections (30) on the cap (24) is equal to or greater than the outside diameter (A) of the outside surface of a cylindrical end of the extension piece (7) and/or the outside diameter (E) of the threaded sections (9, 10) on the handle (3) is equal to or smaller than the inside diameter (F) of the inside surface of the cap (24).

15. The reservoir handle according to claim 1, wherein the operating button (8) is connected to the valve (17) by a rod (21) that extends through the reservoir (15) and which is movably held by one end in an axial guide (22) of the operating button (8).

16. The reservoir handle according to claim 15, wherein the axial guide (22) is a close-tolerance bore with a widened conical entrance (23).

17. The reservoir handle according to claim 16, wherein the valve (17) is provided with a disk (18) that is operated by the rod (21) and which is pushed against a seat (20) by a spring (19) in order to keep the valve (17) closed, and a length of the rod (21) and a depth of the guide (22) are harmonised to one another such that the rod pushes the operating button (8) upwards due to the action of the spring (19) up to a position whereby the second threaded section (10) and the threaded section (30) mating therewith move towards abutment against one another, and whereby the seal (26) is below the level of the filler opening (14).

18. The reservoir handle according to claim 17, wherein one or more cutaways (34) are provided in the inside wall of a cylindrical end of the extension piece (7) below the level of the seal (26) when the operating button (8) is not pressed that ensure that when the seal passes such a cutaway, when the operating button (8) is pressed in to open the valve (17), the reservoir (15) is connected to the environment via the filler opening (14).

19. A reservoir handle for a cleaning element (2), the reservoir handle comprising:

a hollow cylindrical part (3', 7) having an upper end, a lower end, and hollow region located between the upper and lower ends, wherein the bottom end is fastenable to the cleaning element (2);

a refillable reservoir (15) for liquid located within the hollow region, the refillable reservoir (15) having a reservoir top and a reservoir bottom;

a lateral filler opening (14) extending through a wall of the upper end of the hollow cylindrical part;

an outlet (16, 33) located at the reservoir bottom;

an operable valve (17) that opens and closes the outlet (16, 33);

an operating button (8) affixed to the upper end of the hollow cylindrical part, the operating button (8) being connected to the valve (17), the operating button (8) being affixed movably in an axial direction on the upper end of the hollow cylindrical part, wherein pushing the operating button (8) in the axial direction opens the valve (17) to let liquid out of the reservoir (15), and wherein the operating button (8) comprises a stopper (25) that is axially movable in the upper end of the hollow cylindrical part between i) a closed position in which the reservoir (15) is closed off from the environment when the operating button (8) is not pressed in, and ii) a filling position in which the reservoir (15) is connected to the environment via the filler opening (14) in order to be able to fill the reservoir (15).

20. An extension piece (7) for use on a reservoir handle (3) that forms a refillable reservoir (15), the having a bottom end that is fastenable to a cleaning element (2), the extension piece (7) comprising:

a tubular cylindrical body having a cylindrical wall that defines, at cross-sections along a longitudinal length of the tubular cylindrical body, an outside diameter (A) and an inside diameter (B) of the tubular cylindrical body;

a first threaded section (9) located on an exterior surface of the tubular cylindrical body at an upper end of the tubular cylindrical body, an outside diameter (E) of the first threaded section (9) being greater than the outside diameter (A) of the tubular cylindrical body;

a second threaded section (10) located on the exterior surface of the tubular cylindrical body at the upper end of the tubular cylindrical body, the a second threaded section (10) being spaced apart from the first threaded section (9), an outside diameter (E) of the second threaded section (10) being greater than the outside diameter (A) of the tubular cylindrical body;

a lateral filler opening (14) extending through the tubular cylindrical body, the lateral filler opening (14) partially overlapping the second threaded section (10);

a handgrip (6) provided on the exterior surface of the tubular cylindrical body at a lower end of the tubular cylindrical body, wherein the first and second threaded sections (9, 10) divide the upper end of the tubular cylindrical body into a top zone (11) at the uppermost end of the tubular cylindrical body, an intermediate zone (12) between the first and second threaded sections (9, 10), and a lower zone (13) between the second threaded section (10) and the handgrip (6), each of the top zone, the intermediate zone, and the lower zone being without screw thread, wherein, the inside diameter (B) of the tubular cylindrical body at the lower zone (13) is less that the inside diameter (B) of the tubular cylindrical body at the lower end of the tubular cylindrical body comprising the handgrip (6), an interior of the lower end of the tubular cylindrical body comprising the handgrip (6) fits onto a top end of the reservoir handle (3) that forms the refillable reservoir (15) to thereby extend the top end of the reservoir handle (3), the first threaded section (9) is engagable to mate with a threaded section (30) located on an interior surface of a cylindrical shell (29) of a cap (24) comprising a stopper (25) with a base that mounts a seal (26), such that when threaded on the first threaded section (9), the lateral filler opening (14) is exposed for accepting liquid, and the second threaded section (10) is engagable to mate with the threaded section (30) such that when threaded on the second threaded section (10), the seal (26) seals against an interior of the tubular cylindrical body at a cross-section that includes the lower zone (13).

* * * * *